United States Patent [19]

Koenig

[11] Patent Number: 4,681,550

[45] Date of Patent: Jul. 21, 1987

[54] AQUATIC RIDE

[76] Inventor: Dean B. Koenig, 3297 Marilyn Ct., Pleasanton, Calif. 94566

[21] Appl. No.: 786,581

[22] Filed: Oct. 11, 1985

[51] Int. Cl.[4] ..... B63H 11/107; B63H 11/113

[52] U.S. Cl. ..... 440/40; 440/42; 272/1 B

[58] Field of Search ..... 272/1 B; 440/38, 39, 440/40, 42; 441/65, 67; 134/167 R; 15/1.7; 446/163; 251/117, 251, 299; 137/625.33

[56] References Cited

U.S. PATENT DOCUMENTS 3,142,285 7/1964 Sorrentino et al. ..... 440/42
3,372,667 3/1968 Sweet ..... 440/40
4,115,888 9/1978 Sievers ..... 440/38 X
4,157,074 6/1979 Sherwood et al. ..... 440/42 X

*Primary Examiner*—Sherman D. Basinger
*Attorney, Agent, or Firm*—Leonard Bloom

[57] ABSTRACT

An aquatic ride for use in swimming pools of the type having a high water pressure source and line to power a pool cleaning apparatus associated therewith having a support for a person in the pool, a water outlet on the said support operatively and removably connected to the high pressure line, and a valve interposed between the outlet and the high water pressure source whereby the support is guided by controlling high pressure water through the outlet means.

19 Claims, 12 Drawing Figures

AQUATIC RIDE

FIELD OF THE INVENTION

The following invention relates generally to a riding device for use in swimming pools having a conventional automatic pool cleaner. The device is coupled operatively to an associated source of high water pressure by replacing the cleaner with the riding device.

BACKGROUND OF THE INVENTION

With the advent of low cost pool production techniques, solar heaters and thermal blankets adapted to retain heat within an enclosure such as a pool, the prevalence of pools in America has increased to areas beyond the Sun Belt. Associated with permanently placed pools are filtration units run periodically for maintaining pool hygiene, and some filtration units include a high pressure output line which powers a pool cleaner or other instrumentality for the purposes of enhancing and encouraging migration of debris to a lower portion of the pool for subsequent removal. Pool cleaners typically operate on a line pressure of forty to sixty-five pounds per square inch and more about the pool while tethered to the high pressure line.

These pool cleaning devices are sufficiently efficient to require only periodic operation, typically from two to six hours per day. The remainder of the time, the apparatus associated with the pool cleaning instrumentality, particularly the high pressure line, remains idle.

Surprisingly, to date there has been no amusement device or exercising instrumentality which utilizes the high pressure line when it is not used to clean the pool.

The following patents reflect the state of the art of which applicant is aware, in so far as those patents appear relevant to the process at hand:

U.S. Pat. Nos. 3,384,910, Heston et al., May 28, 1968
3,435,471, Drennen, Apr. 1, 1969
3,626,428, Collaro, Dec. 7, 1971
4,028,761, Taylor, June 14, 1977
4,206,933, Koch, June 10, 1980
4,264,313, Kort, Apr. 28, 1981

In view of the following detailed description of the preferred embodiment, it should be clear that any similarities between the instant application and the known prior art is merely coincidental, since among other things, one of these known prior art instrumentalities utilizes the high pressure water line as the source for an amusement or exercise ride.

SUMMARY AND OBJECTS OF THE INVENTION

Accordingly, this invention has as a primary objective the utilization of an existing high pressure line commonly relegated to mere pool maintenance for the purposes of powering an aquatic device for both amusement and exercise.

A further object of this invention contemplates providing a device as characterized above which is extremely safe to use, lends itself to mass production techniques and is durable in construction.

It is yet a further object of this invention to provide a device as characterized above which readily removably couples to an existing high pressure line commonly used for skimming and cleaning pools so that the amusement device and the pool skimming device can be selectively coupled with a minimal amount of down time and inconvenience.

These and other objects will be made manifest when considering the following detailed specification when taken in conjunction with the associated drawing figures wherein there has been provided an aquatic ride for use in swimming pools or the like having a high water pressure pool cleaning apparatus associated therewith which includes an instrumentality for supporting a person, this instrumentality operatively and removably connected to the source of high water pressure, a water outlet instrumentality on the supporting instrumentality and valve means interposed between the high pressure source and the water outlet whereby the supporting instrumentality is guided by controlling high pressure water through the outlet.

BRIEF DESCRIPTION OF THE DRAWING FIGURES

BRIEF DESCRIPTION OF THE PREFERRED EMBODIMENTS

Figure 1:
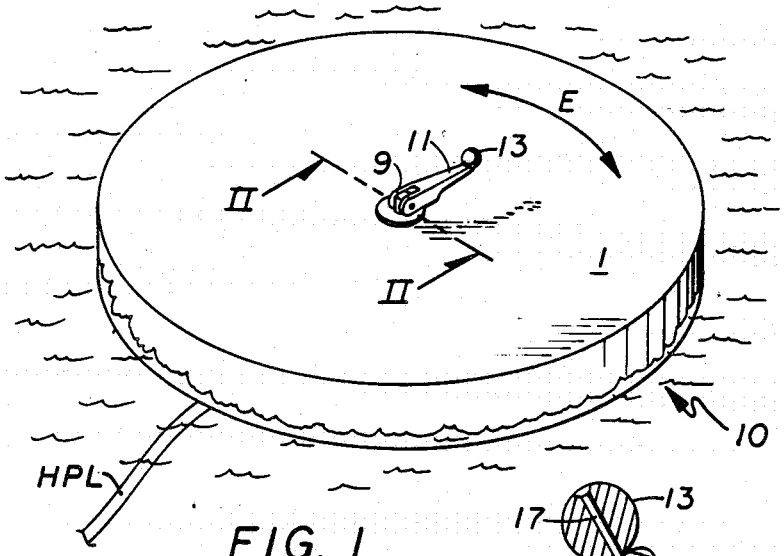
FIG. 1 is a perspective view of one embodiment of the apparatus according to the present invention.

Referring to the drawings now, wherein like reference numerals refer to like parts throughout the various drawing figures, reference numeral 10 is directed to the aquatic ride according to one form of the present invention.

As illustrated in the drawing FIGS. 1 through 4, the device includes a support 1 upon which the rider is situated, the support 1 characterized in that it has a differential in specific gravity with respect to the liquid within which it is to be disposed, and an external contour which may vary as a function of the maneuvers intended to be performed by the person riding the support. That is to say, while a specific embodiment contemplates providing the support 1 as formed from any of a family of open or closed cell foams having a lesser specific gravity than water in a pool thereby rendering the support buoyant, the buoyancy may be altered by providing chambers within the support which can be selectively filled the buoyancy. Alternatively one may select the material forming the support from a class of materials having a specific gravity such that the support is partially submerged or even totally submerged. By providing buoyancy chambers within the support 1, they can selectively be weighted to alter the operating characteristics of the support. It should be equally clear that the support could be inflatable. Also, the external contour of the support may be varied as is desired to effect different maneuverability characteristics and/or to simulate other devices.

The FIGS. 1–4 embodiment contemplates the provision of a control instrumentality at a geometrical center of the support, the instrumentality formed from a shaft 7 adapted to vertically reciprocate within a bore associated with the support 1, the bore of the support 1 being protected by means of a sleeve 2 having a radially extending flange 3 on a top face of the support 1.

Figure 3:
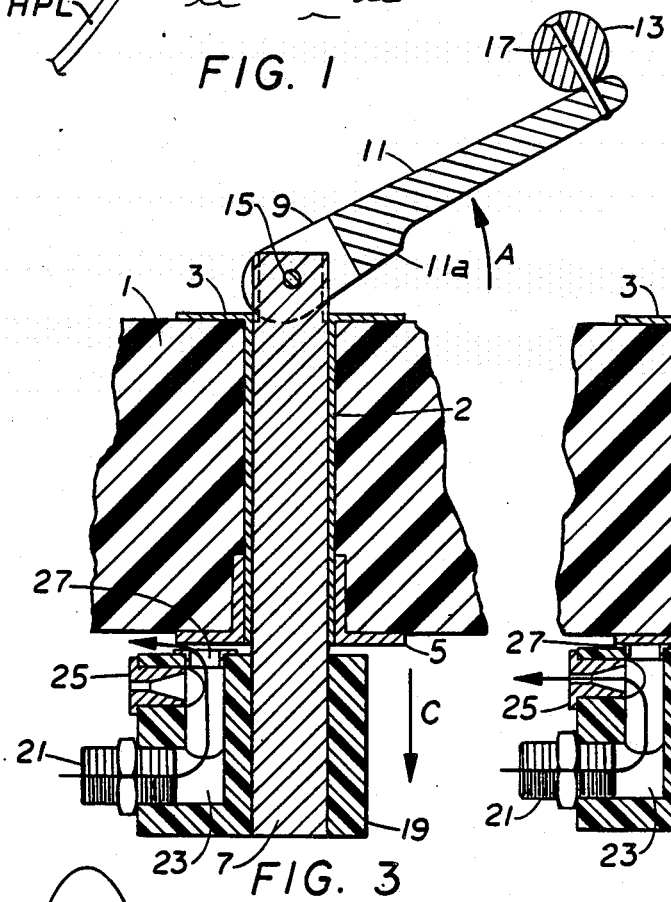
FIG. 3 is a sectional view taken along lines 3—3 of FIG. 2 in a first operative position.
Figure 4:
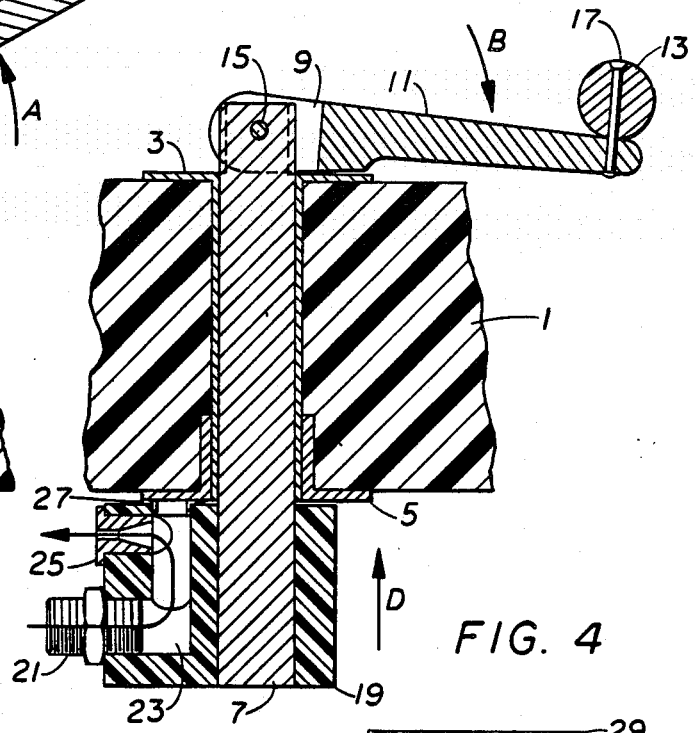
FIG. 4 is a similar sectional view of that which is shown in FIG. 3 showing the apparatus in a second operational mode.

A lower most portion of the shaft 7 is fixed within a housing 19 capable of moving the housing in either a negative vertical sense in accordance with the directional arrow C or in positive vertical sense in accordance with the directional arrow D, FIGS. 3 and 4 respectively. Positive and negative vertical displacement of the shaft 7 and therefore the housing 19 occurs by rotation of a lever 11 in the direction of the arrows A or B of FIGS. 3 and 4 respectively in the following manner.

An end of the lever 11 adjacent an upwardly extending necked down portion 8 of the shaft 7 has a bifurcated end 9 adapted to straddle planar sides of the necked down portion 8, and a pivot pin 15 passing through portion 8 and forks of the bifurcated portion 9 allow pivotal movement of the lever 11 as suggested by the arrows A and B. The radially extending flange 3 serves as a bearing surface which acts against a lower cam portion 11*a* of the lever 11 to facilitate positive and negative vertical displacement of the shaft 7. A ball grip 13 at an end of the lever 11 remote from the bifurcation 9 assists in translating the lever 11 from a first to a second position. The ball 13 is rotatably mounted on an extremity of lever 11 by means of pivot pin 17.

The net effect of vertical reciprocation of the shaft is to cause concomitant displacement of the housing 19 as shown in FIGS. 3 and 4 at extremities of the housing travel. To this end, a radially extending flange 5 fixes the sleeve portion 2 adjacent the housing serves as a bearing surface against which the housing and 19 can abut in one extreme position.

The housing 19 includes a coupling 21 threadedly fastened thereto allowing access to an interior passage way 23. The coupling has an external portion adapted to expeditiously fasten to an associated coupling or fastener on a high pressure line HPL commonly used in most automatic pool cleaners (see FIG. 1).

Once high pressure fluid is directed into the housing passage way 23, the high pressure water has one of two avenues to escape. The passage way 23 has a portion parallel to and radially offset from the shaft 7, and another portion leading to the coupling 21 forming a substantially L shaped passage way. An extremity of the L shaped passage way remote from the coupling 21 includes a teflon type bushing 27 having a peripheral flange adapted to abut against a top most edge of the housing 19 in such a manner that when the shaft is in the position shown in FIG. 4, the bushing is in tangential registry with a lower most face of the radially extending flange 5. Water under high pressure will prefer not to pass beyond this point and instead migrate out a jet 25 embodied as a converging nozzle threadedly embedded in a second outlet leading to passage 23 parallel to but horizontally offset from the coupling 21. Water will emerge from the nozzle 25 at an increased velocity when compared to the inlet pressure of forty to sixty-five pounds, and when the support 1 is disposed in a fluid such as water, will provide a means for propelling the support.

However, in the position of FIG. 3, when the bushing 27 is spaced from the flange 5, since the cross sectional diameter of the outlet of the teflon bushing is greater than that of the nozzle 25, water will tend to impinge against the bearing surface of the flange 5 facing the bushing 27 and be dispersed radially in all directions causing substantially no movement of the amusement ride indicative of a neutral position for the lever 11. Note that the lever 11 can rotate in an arc (arrow E) which rotates housing 19 for further maneuverability.

Figure 2:
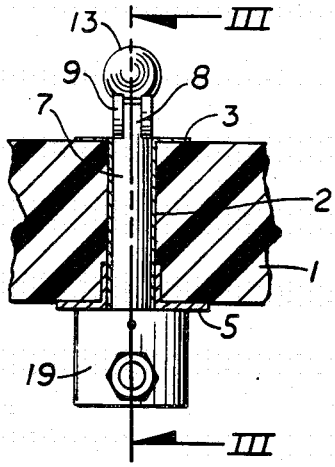
FIG. 2 is a sectional view taken along lines 2—2 of FIG. 1.
Figure 5:
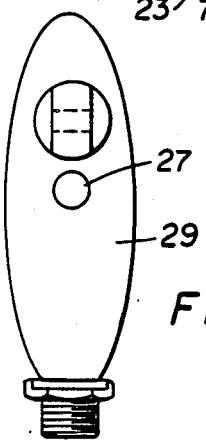
FIG. 5 is a top plan view of an alternative configuration from that which is shown in FIGS. 3 and 4 with respect to a lower most portion thereof.
Figure 6:
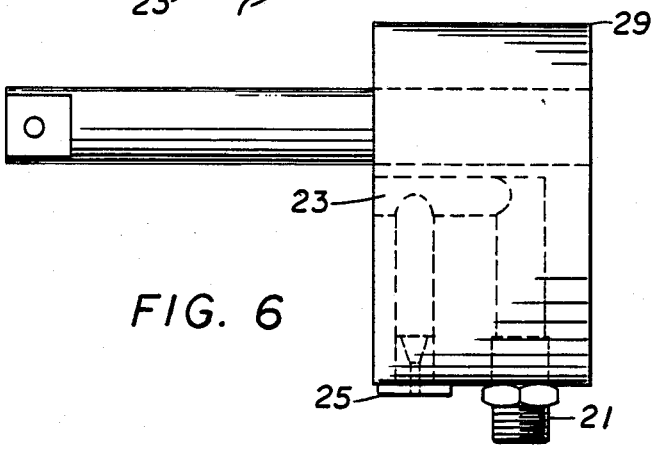
FIG. 6 is a side view of that which is shown in FIG. 5.

FIGS. 5 and 6 reflect a configuration for the housing 19 which is somewhat different from that which is shown in FIGS. 2–4. Whereas a bottom plan view of FIG. 2 would reflect that the housing 19 is substantially cylindrical, but with the disposition of the shaft 7 offset from the geometrical center thereof, the housing 29 of FIGS. 5 and 6 is substantially elliptically shaped. Alternatively, housing 29 can be shaped in the form of a tear drop defining a form of air foil which is symmetrical with respect to a longitudinal axis whereby a fluidic pressure gradient will not exist on either lateral aspect of the housing 29.

FIGS. 7 through 11 are directed to a further embodiment illustrative of at least one other ride and perhaps a plurality of rides when hybridized with the previously discussed embodiments. More particularly, whereas in the earlier embodiments the water jet was centrally disposed with respect to the person support 1, the current embodiment is characterized in having a plurality of jets disposed outboard from the geometrical center of a support 30, each of the plurality of the jets capable of both angulation about the longitudinal axis of its associated lever support shaft in the direction of arrow E, and also selective engagement of each jet by moving the lever 31 in the direction of the arrows A and B as will be described.

Figure 11:
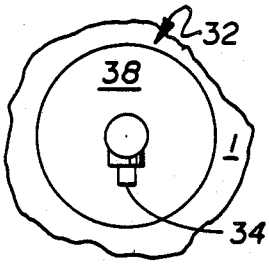
FIG. 11 is a bottom plan view of that which is shown in FIG. 10.

As shown in FIGS. 7 through 11, the aquatic ride according to this embodiment includes a support platform 30 and a high water pressure distribution manifold 32 centrally disposed thereon. FIG. 11 illustrates a bottom view of the manifold 32 and includes a coupling 34 adapted to removably connect to the high pressure line HPL (not shown) to provide the source of power. The coupling 34 communicates with a passage way 36 extending upwardly into the manifold 32, the passageway 36 defined by an enclosure of substantially cylindrical configuration having a top wall 37 of greater radius than a section transverse to the longitudinal axis of the cylinder. Wall 37 is foraminous to allow water to pass to outlets 40. By having a marginal periphery of the wall 37, it can be contained by and supported upon a lower wall 38 of the manifold 32. Moreover, the manifold 32 can rotate relative to the longitudinal axis of the passage way 36 without twisting the line HPL. A suitable seal 39 connects the bottom wall 38 of the manifold 32 to tubular manifold outlets 40 schematically depicted as having two passage ways for simplicity in illustration. The two passage ways run perpendicular to the longitudinal axis of passage way 36. The tubular outlet 40 is carried in depending relation from a manifold core support 41 extending downwardly from a top wall 42 of the manifold 32.

Figure 7:
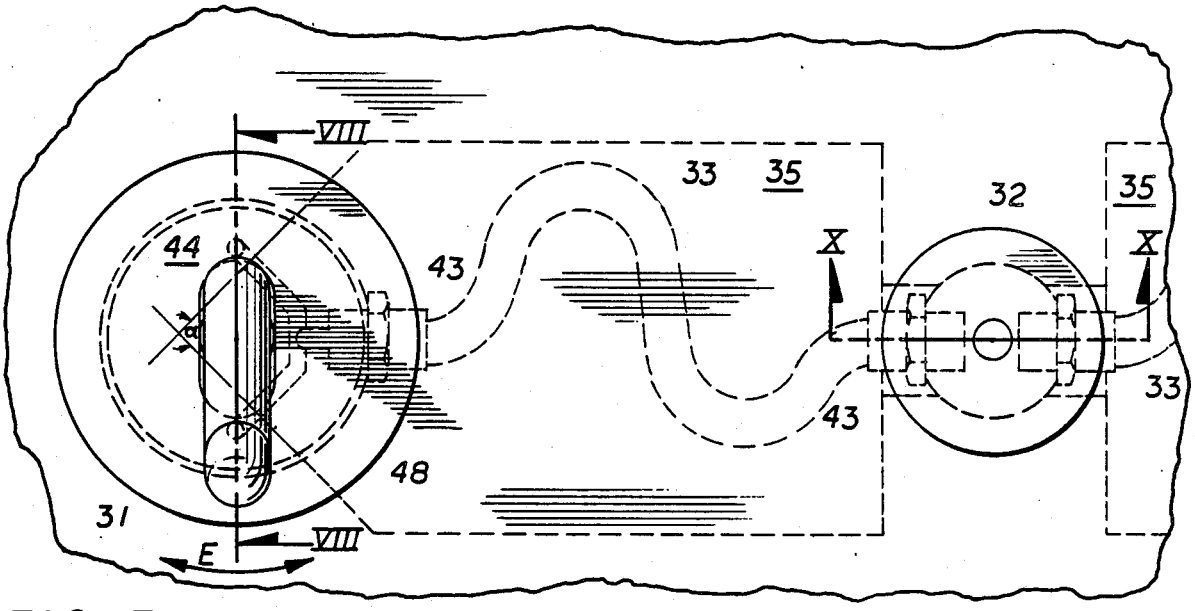
FIG. 7 is an alternative embodiment to that which is shown in FIG. 1 partially fragmented to show those areas of divergence for purposes of clarity.
Figure 8:
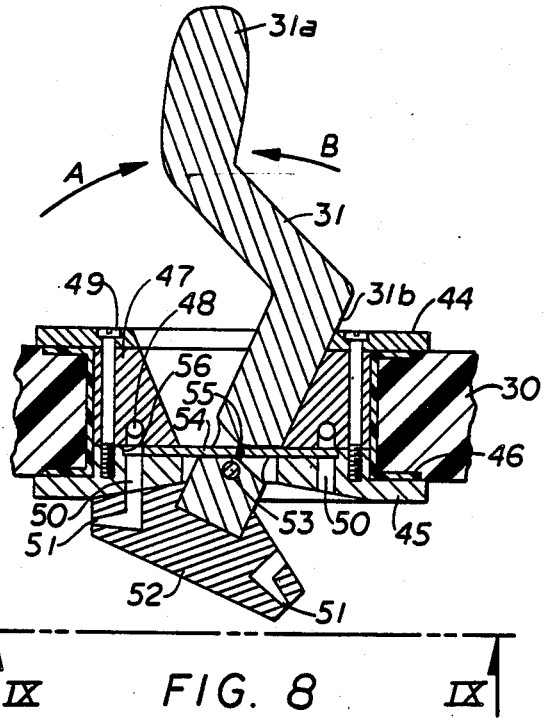
FIG. 8 is a sectional view taken along lines 8—8 of FIG. 7.
Figure 9:
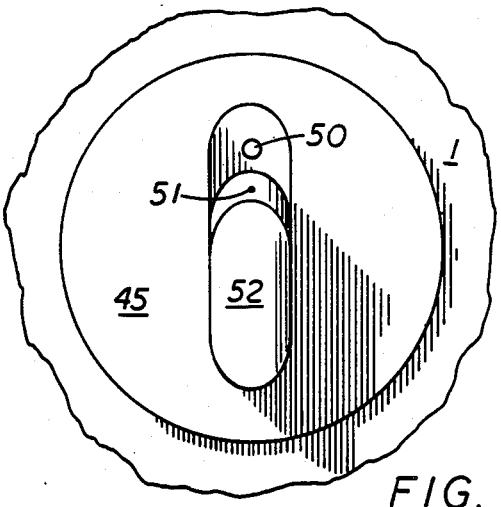
FIG. 9 is bottom plan view taken along lines 9—9 of FIG. 8.
Figure 10:
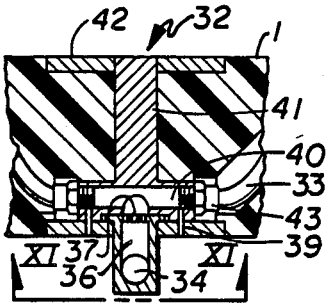
FIG. 10 is sectional view taken along lines 10—10 of FIG. 7.

Referring to FIG. 7, water passes beyond passage ways 40 to flexible hoses 33 by means of coupling 43. The flexible hose 33 is contained within a hollow passage way 35 provided within the platform 30 so that the flexible hose 33 can move within the hollow 35 through an angle alpha where it connects to coupling 43 of housing 47. An extremity of the hose 33 remote from the manifold 32 connects to a means for providing a high pressure jet type outlet formed within a housing 47, shown in FIG. 8. More particularly, the coupling 43 housing 47 allows fluid communication to a branched passage way 48 in the housing 47 allowing water to migrate under high pressure along each of two branches.

Each branch communicates in turn with a vertical duct 50 provided in a bottom plate 45 fastened to a top support plate 44 by means of bolts 49, with the jet housing 47 interposed there between. As shown, the support member 30 which circumscribes the jet housing 47 includes a reinforcing wall 46 adjacent to the housing, the reinforcing wall 46 having a substantially C shaped section formed from a suitable material to withstand abrasion when rotating the jet housing 47, and conceivably to be selected from a class of materials such as teflon providing minimal friction between the jet housing 47 and the wall 46.

Each of the vertically extending ducts 50 communicates alternatively with L shaped outlets 51 formed in a toggle 52 pivoted to a lower most extremity **31*b* of lever 31. Each outlet 51 has a tapered, outwardly converging port for fluid velocity increases thereat. The lower most vertical section 31*b* of the lever 31 is pivoted at 53 to a portion of the bottom plate 45 so that when lever 31 is moved in the direction of the arrows A or B, switching is experienced at the toggle housing 52 supporting the two outlet valves 51**.

Up from the pivot 53, a slide plate 54 is pivoted at 55 to lower lever portion **31*b*. The plate 54 is located within a hole passing through the lower lever, the slide plate 54 serving as a valve which alternatively occludes either vertical section 50 interrupting communication between one branched outlet 48 and the nozzle 51. As shown in one extreme position of FIG. 8, the nozzle 51 on the left is operative allowing motion of the platform 30 in the direction of the arrow F, and little water, if any, passes through the other portion of branch 48, having been occluded by the slide valve plate 54. It should be evident that an orientation where the axis of lower portion 31*b* is vertical allows partial occlusion of both vertical passage ways 50, which is tantamount to a (neutral) position with water passing out of both nozzles 51 offsetting any impulse which either may have provided. As shown, the lever 31 has a top most portion 31*a*** serving as a hand grip.

By providing a plurality of outboard jets and control levers, this device lends itself to complex tricks performed on the support platform. For example, when two diametrically opposed control levers are provided with the corresponding water outlet hardware, relatively rapid spins and unilateral translation are possible.

If the specific gravity of the support members 1 or 30 is strategically selected or weighted, the person riding the device can be partially submerged. If scuba equipment is available, the rider can be totally submerged in which event a slight downward declination of the nozzle outlets 51 will provide lift as would be desired.

Figure 12:
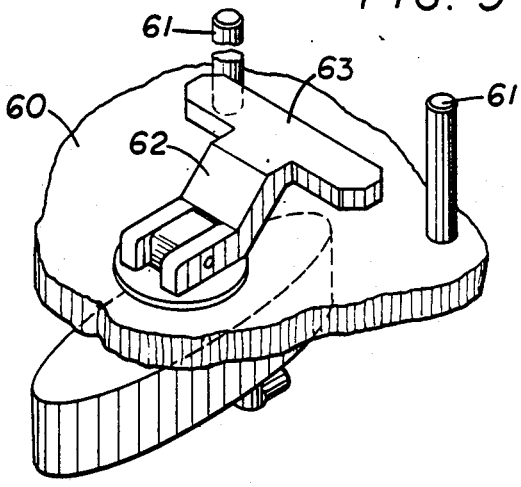
FIG. 12 is a perspective view, partially fragmented of a further form of the invention.

Alternatively, FIG. 12 reveals an embodiment for surface and below surface use where the support surface 60 is a thin disc dimensioned to preferrably support merely the forearms and hands of the person, with the remainder of the person's body trailing in the water. The support 60 is grasped by hand posts 61 placed strategically adjacent a modified lever 62. One end of lever 62 is pivoted to the shaft (see e.g. shaft 7 of FIG. 3), while the opposite end of lever 62 defines a "T" type handle having transverse member 63 extending towards hand posts 61 and reachable by the person's thumbs. Since the disc shaped support 60 is so thin, maneuverability can be effected by providing a turning force through the hand posts 61.

Although not shown, it should be evident that protective devices such as stirrups, a purchase areas for one's feet, a helmet, or a seat belt might be desired. Furthermore, while supports 1 and 30 were depicted as being made of foam, the support could be at least partially inflatable. Moreover, having this describe the invention, it should be apparent that numerous structural modifications are contemplated as being a part of this invention as set forth here and above and defined here and below by the claims.

I claim:

1. An aquatic ride for use in swimming pools or the like of the type having a high water pressure source and line to power a pool cleaning apparatus associated therewith comprising in combination:

a means for supporting a person in the pool formed from a material having a specific gravity different from water in the pool to control its horizontal elevation within the pool;

a water outlet means on said supporting means operatively and removably connected to the high pressure line, and valve means interposed between said outlet means and the high water pressure source whereby said supporting means is guided by controlling high pressure water through said outlet means wherein said water outlet means includes a housing having a passage way in fluid communication with the high pressure line, coupling means removable connecting the high pressure line to said passage way, and first and second outlets in fluid communication with said passage way respectively defining a neutral position and a propulsive position wherein said first and second outlets are selectively engaged by a shaft fixed to said housing and carried on said supporting means having a lever associated therewith, said lever having two degrees of freedom: one degree of freedom adapted to selectively engage one or the other of said outlets, the other degree of freedom adapted to change the orientation of said housing with respect to said supporting means to vary the angle of attack of said water outlet and thereby serve as directional control for said ride, wherein said shaft passes through said supporting means, with said housing disposed adjacent a bottom surface of said supporting means and said lever disposed adjacent a top surface thereof, a camming surface on said lever means adapted to bear against a top surface of said supporting means to cause vertical translation of said shaft when said lever is rotated in a vertical plane, said lever attached to said shaft by means of a bifurcation straddling a necked down upper portion of said shaft, whereby vertical displacement of said shaft alternatively occludes said first outlet means, such that when said first outlet is occluded, said second outlet is operative, but when said first outlet is not occluded said second outlet is effectively disabled, said first outlet, when not occluded defining a neutral position, wherein said housing passage way is substantially L shaped, said first outlet disposed at a vertical top most extremity of one leg of L shaped passage way adapted to bear against a bearing surface on a bottom face of said support means, said second outlet parallel to but horizontally offset from a horizontal other leg of said L shaped passageway.

2. An aquatic ride for use in swimming pools or the like of the type having a high water pressure source and line to power a pool cleaning apparatus associated therewith, comprising in combination:

a means for supporting a person in the pool, formed from a material having a specific gravity different from water in the pool to control its horizontal elevation within the pool;

a water outlet means on said supporting means operatively and removably connected to the high pressure line, and valve means carried on said support means controlled by the person on said support means having means to change the angle of attack of said outlet means and therefore the direction of said ride, wherein said water outlet means includes a housing having a passage way in fluid communication with the high pressure line, coupling means removably connecting the high pressure line to said passage way, and first and second outlets in fluid communication with said passage way respectively defining a neutral position and a propulsive position, wherein said first and second outlets are selectively engaged by a shaft fixed to said housing and carried on said supporting means having a lever associated therewith, said lever having two degrees of freedom: one degree of freedom adapted to selectively engage one or the other of said outlets, the other degree of freedom adapted to change the orientation of said housing with respect to said supporting means to vary the angle of attack of said water outlet and thereby serve as directional control for said ride, wherein said shaft passes through said supporting means, with said housing disposed adjacent a bottom surface of said supporting means and said lever disposed adjacent a top surface thereof, a camming surface of said lever means adapted to bear against a top surface of said supporting means to cause vertical translation of said shaft when said lever is rotated in a vertical plane, said lever attached to said shaft by means of a bifurcation straddling a necked down upper portion of said shaft, whereby vertical displacement of said shaft alternatively occludes said first outlet means, such that when said first outlet is occluded, said second outlet is operative, but when said first outlet is not occluded said second outlet is effectively disabled, said first outlet, when not occluded defining a neutral position, wherein said housing passage way is substantially L shaped, said first outlet disposed at a vertical top most extremity of one leg of said L shaped passage way adapted to bear against a bearing surface on a bottom face of said support means, said second outlet parallel to but horizontally offset from a horizontal other leg of said L shaped passage way.

3. An aquatic ride for use in swimming pools or the like of the type having a high water pressure source and line to power a pool cleaning apparatus associated therewith, comprising in combination:

a means for supporting a person in the pool, formed from a material having a specific gravity different from water in the pool to control its horizontal elevation within the pool, a water inlet means on said supporting means operatively and removably connected to the high pressure line, and plural valve means carried on said support means each communicating with said high pressure line through a common manifold means centrally disposed on said support platform, each of said valve means adapted to be selectively engagable and oriented to further control the ride, wherein said manifold means includes a vertically extending passage way having a foraminous top wall adapted to communicate with a horizontally extending passage way which has a plurality of branches each communicating with one of said valve means, a flexible hose extending one to each said valve means provided in a hollow of said support means to accommodate rotation of a valve means housing with respect thereto, said valve means housing operatively coupled to said flexible hose and including a branched passage way extending therefrom, shaft means to selectively occlude one of said passage ways which concomitantly enables one of a pair of nozzle means connected to a toggle support depending from said shaft means thereby allowing water under high pressure to pass through one said nozzle and disable the other said nozzle.

4. An aquatic ride for use in swimming pools or the like of the type having a high water pressure source and line to power a pool cleaning apparatus associated therewith, comprising in combination:

a means for supporting a person in the pool, a water outlet means on said supporting means operatively and removably connected to the high pressure line, and valve means interposed between said outlet means and the high water pressure source whereby said supporting means is guided by controlling pressure water through said outlet means, said high pressure line, outlet means and valve means are united to a housing having a passageway, wherein said housing passage way is substantially L shaped, a first outlet disposed at a vertical top most extremity of one leg of said L shaped passage way adapted to bar against a bearing surface of a bottom face of said support means, and a second outlet parallel to but horizontally offset from a horizontal other leg of said L shaped passageway which connects to the high pressure line.

5. The ride of claim 4 wherein said supporting means is formed from a material having a specific gravity different from water in the pool to control its horizontal elevation within the pool.

6. The ride of claim 5, wherein the passage way of the housing of the said water outlet means defines a neutral position and a propulsive position.

7. The ride of claim 6 wherein said first and second outlets are selectively engaged by a shaft fixed to said housing and carried on said supporting means having a lever associated therewith, said lever having two degrees of freedom: one degree of freedom adapted to selectively engage one or the other of said outlets, the other degree of freedom adapted to change the orientation of said housing with respect to said supporting means to vary the angle of attack of said water outlet and thereby serve as directional control for said ride.

8. The device of claim 7 wherein said shaft passes through said supporting means, with said housing disposed adjacent a bottom surface of said supporting means and said lever disposed adjacent a top surface thereof, a camming surface on said lever means adapted to bear against a top surface of said supporting means to cause vertical translation of said shaft when said lever is rotated in a vertical plane, said lever attached to said shaft by means of a bifurcation straddling a necked down upper portion of said shaft, whereby vertical displacement of said shaft alternatively occludes said first outlet means, such that when said first outlet is occluded, said second outlet is operative, but when said first outlet is not occluded said second outlet is effectively disabled, said first outlet, when not occluded defining a neutral position.

9. An aquatic ride for use in swimming pools or the like of the type having a high water pressure source and line to power a pool cleaning apparatus associated therewith, comprising in combination:

a means for supporting a person in the pool, a water outlet means on said supporting means operatively and removably connected to the high pressure line, and valve means carried on said support means controlled by the person on said support means having means to change the angle of attack of said outlet means and therefore the direction of said ride, said high pressure line, outlet means and valve means are united to a housing having a passage way, wherein said housing passage way is substantially L shaped, a first outlet disposed at a vertical top most extremity of one leg of said L shaped passage way adapted to bear against a bearing surface on a bottom face of said support means, and a second outlet parallel to but horizontally offset from a horizontal other leg of said L shaped passage way which connects to the high pressure line.

10. The ride of claim 9 wherein said supporting means is formed from a material having a specific gravity different from water in the pool to control its horizontal elevation within the pool.

11. The ride of claim 10, wherein said water outlet means further includes coupling means for removably connecting the high pressure line to said passage way of the housing, and first and second outlets in fluid communication with said passage way respectively defining a neutral position and a propulsive position.

12. The ride of claim 11 wherein said first and second outlets are selectively engaged by a shaft fixed to said housing and carried on said supporting means having a lever associated therewith, said lever having two degrees of freedom: one degree of freedom adapted to selectively engage one or the other of said outlets, the other degree of freedom adapted to change the orientation of said housing with respect to said supporting means to vary the angle of attack of said water outlet and thereby serve as directional control for said ride.

13. The device of claim 12 wherein said shaft passes through said supporting means, with said housing disposed adjacent a bottom surface of said supporting means and said lever disposed adjacent a top surface thereof, a camming surface of said lever means adapted to bear against a top surface of said supporting means to cause vertical translation of said shaft when said lever is rotated in a vertical plane, said lever attached to said shaft by means of a bifurcation straddling a necked down upper portion of said shaft, whereby vertical displacement of said shaft alternatively occludes said first outlet means, such that when said first outlet is occluded, said second outlet is operative, but when said first outlet is not occluded said second outlet is effectively disabled, said first outlet, when not occluded defining a neutral position.

14. A propulsion device using incompressible fluid under high pressure substantially the range of forty to sixty-five pounds per square inch as a propelling force, comprising, in combination:

means for coupling said device to a source of high fluid pressure, an inlet for receiving the high pressure fluid, a passageway in fluid communication with said inlet having first and second outlets, said second outlet oriented to emit the fluid in a substantially horizontal direction so that said device is propelled in an opposite horizontal direction, said first outlet is oriented to emit the fluid in a substantially vertical direction towards a bearing surface defining a neutral, nonpropulsive position, and means to forcibly close said first outlet using said bearing surface and overcoming the fluid pressure thereby diverting all fluid through said second outlet.

15. The device of claim 14 wherein said second outlet has a more restrictive opening than said first outlet so that the fluid naturally prefers exiting through said first outlet.

16. The device of claim 15 wherein said outlets are carried in a housing and said passageway is substantially "L" shaped wherein said first outlet is disposed at a vertical top most extremity of one leg of said "L" shaped passageway and said bearing surface is disposed on a bottom support surface means of said propulsive device, and said second outlet is parallel to but horizontally offset from a horizontal other leg of said "L" shaped passageway which secures the source of high pressure fluid.

17. The device of claim 16 wherein said support surface means is formed from a material having a specific gravity different from fluid within which it is disposed.

18. The ride of claim 17 wherein said first and second outlets are selectively engaged by a shaft fixed to said housing and carried on said supporting means having a lever associated therewith, said lever having two degrees of freedom: one degree of freedom adapted to selectively engage one or the other of said outlets, the other degree of freedom adapted to change the orientation of said housing with respect to said supporting means to vary the angle of attack of said fluid outlet and thereby serve as directional control for said ride.

19. The device of claim 18 wherein said shaft passes through said supporting means, with said housing disposed adjacent a bottom surface of said supporting means and said lever disposed adjacent a top surface thereof, a camming surface on said lever means adapted to bear against a top surface of said supporting means to cause vertical translation of said shaft when said lever is rotated in a vertical plane, said lever attached to said shaft by means of a bifurcation straddling a necked down upper portion of said shaft, whereby vertical displacement of said shaft alternatively occludes said first outlet means, such that when said first outlet is occluded, said second outlet is operative, but when said first outlet is not occluded said second outlet is effectively disabled, said first outlet, when not occluded defining a neutral position.

* * * * *